US007060043B2

(12) United States Patent
Huang

(10) Patent No.: US 7,060,043 B2
(45) Date of Patent: Jun. 13, 2006

(54) MASSAGE DEVICE

(76) Inventor: Chien-Ming Huang, 11-1 Fl., No. 23, Sec. 2, Keelung Rd., Taipei (TW)

( * ) Notice: Subject to any disclaimer, the term of this patent is extended or adjusted under 35 U.S.C. 154(b) by 53 days.

(21) Appl. No.: 10/954,164

(22) Filed: Oct. 1, 2004

(65) Prior Publication Data

US 2006/0074359 A1 Apr. 6, 2006

(51) Int. Cl.
*A61H 7/00* (2006.01)

(52) U.S. Cl. ..... 601/94; 601/95; 601/103; 601/134

(58) Field of Classification Search ..... 601/84, 601/86, 87, 89, 90, 93, 94, 95, 97, 98, 100, 601/101, 104, 107, 108, 110–112, 116, 126, 601/133, 134
See application file for complete search history.

(56) References Cited

U.S. PATENT DOCUMENTS 4,016,872 A * 4/1977 Yamamura et al. ..... 601/118
6,599,261 B1 * 7/2003 Chen ..... 601/115
6,629,940 B1 * 10/2003 Shimizu ..... 601/133
6,969,361 B1 * 11/2005 Hsieh ..... 601/127
2005/0215927 A1 * 9/2005 Chang ..... 601/90

* cited by examiner

*Primary Examiner*—Quang D. Thanh
(74) *Attorney, Agent, or Firm*—Rosenberg, Klein & Lee

(57) ABSTRACT

A massage device has a platform, a motor assembly, a transmission assembly, a massage arm assembly and two massage disk assemblies. The motor assembly has a motor mounted on the platform. The transmission assembly is driven by the motor and has a transverse axle mounted rotatably on the platform. The massage arm assembly has a shoulder mounted on the platform and two rocker arms rotatably mounted on the shoulder. The massage disk assemblies are mounted on the transverse axle and each has a massage pad. The massage arm and disk assemblies move simultaneously in response to the transmission and provide effective massages to multiple muscle groups of a human body.

4 Claims, 7 Drawing Sheets

MASSAGE DEVICE

BACKGROUND OF THE INVENTION

1. Field of the Invention

The present invention relates to a massage device, and more particularly to a massage device for massaging multiple muscle groups of the human body, such as the shoulder and neck.

2. Description of Related Art

Massage devices are used to soothe tense muscles of a user so as to let the user feel at ease physically. Various known massage apparatuses have been proposed which employ vibrating or rotating members. However, such known apparatuses only provide single massaging action to one muscle group of the human body, such as foot muscles.

To overcome the shortcomings, the present invention provides a massage device to mitigate or obviate the aforementioned problems.

SUMMARY OF THE INVENTION

The main objective of the invention is to provide a massage device that applies an effective massaging action to multiple parts of the human body, and which simulates the action of a human masseur at least to some extent.

A massage device has a platform, a motor assembly, a transmission assembly, a massage arm assembly and two massage disk assemblies.

The motor assembly has a motor mounted on the platform. The transmission assembly is driven by the motor and has a transverse axle mounted rotatably on the platform. The massage arm assembly has a shoulder mounted on the platform and two rocker arms rotatably mounted on the shoulder. The massage disk assemblies are mounted on the transverse axle and each has a massage pad.

Other objectives, advantages and novel features of the invention will become more apparent from the following detailed description when taken in conjunction with the accompanying drawings.

DETAILED DESCRIPTION OF PREFERRED EMBODIMENT

Figure 1:
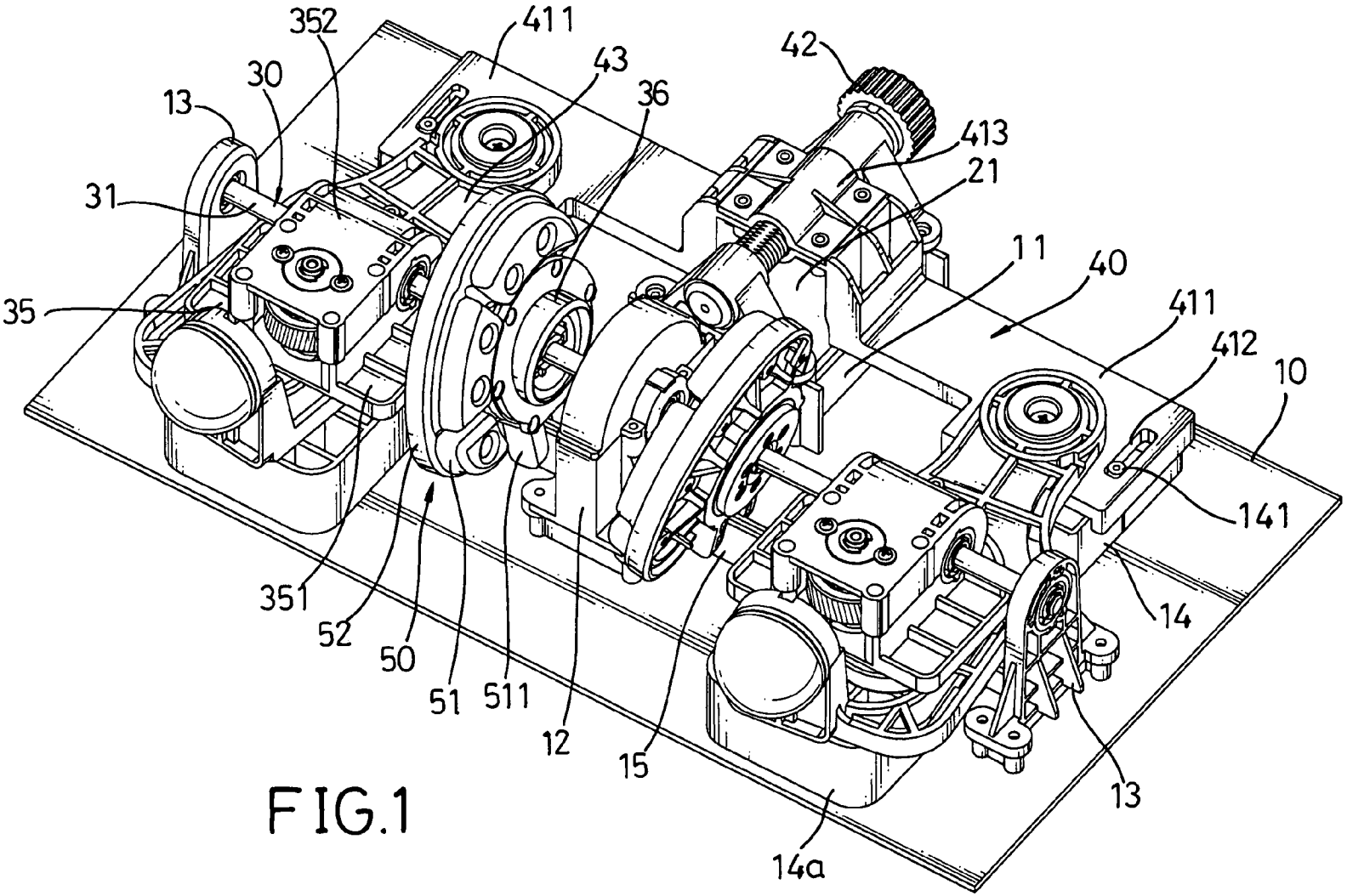
FIG. 1 is a perspective view of a massage device in accordance with the present invention.
Figure 2:
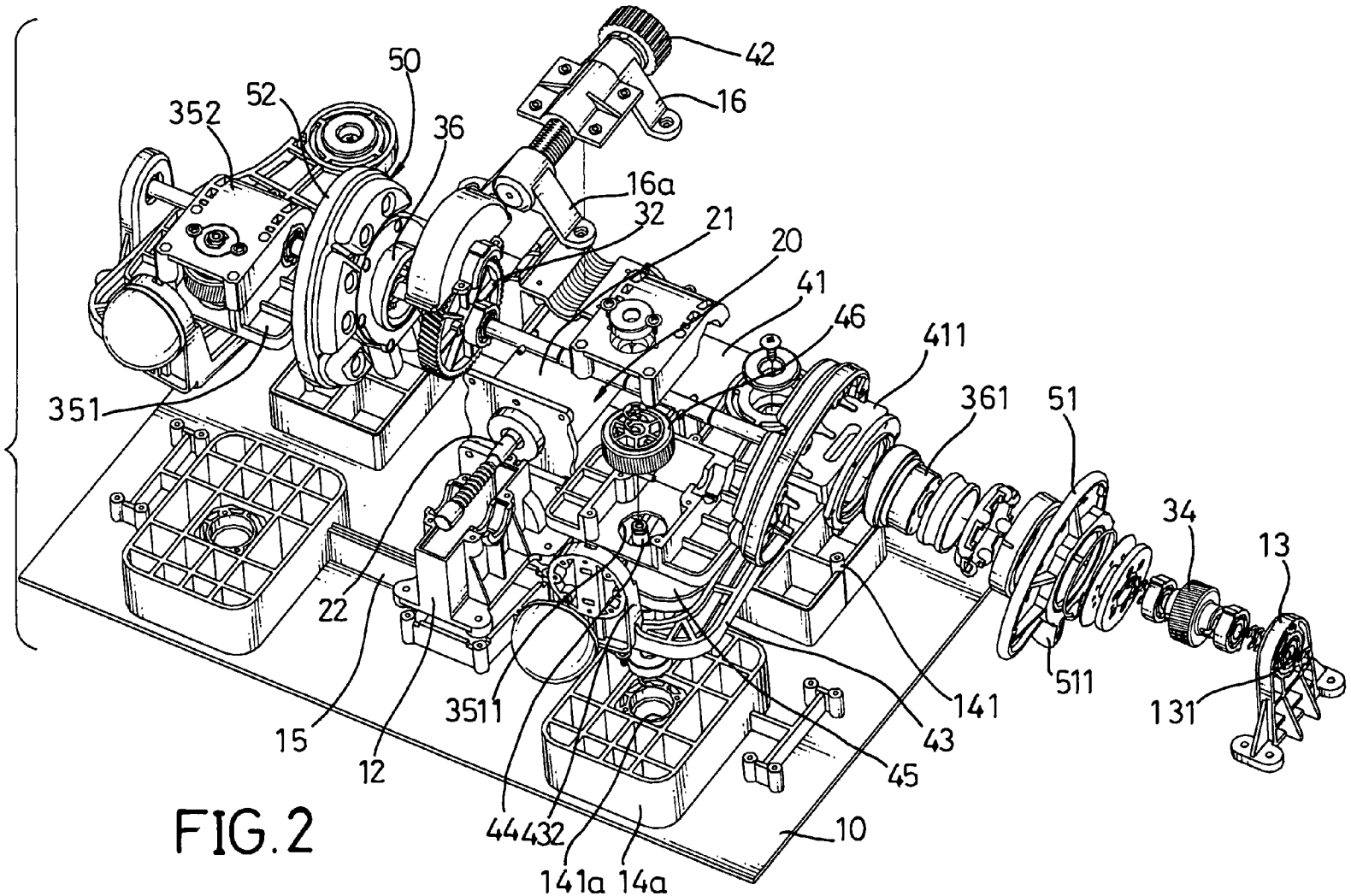
FIG. 2 is an exploded perspective view of the massage device in FIG. 1.

With reference to FIGS. 1 and 2, a massage device in accordance with the present invention comprises a platform (10), a motor assembly (20), a transmission assembly (30), a massage arm assembly (40) and two massage disk assemblies (50).

The platform (10) has a top surface, two sides, a motor bracket (11), a worm gear casing (12), two transmission brackets (13), two shoulder brackets (14), two post-rotating brackets (14*a*), two transverse rails (15) and two optional threaded shaft brackets (16, 16*a*).

The motor bracket (11) is formed on the top surface of the platform (10). The worm gear casing (12) is mounted on the top surface of the platform (10) ahead the motor bracket (11) and has two sides and a room. The transmission brackets (13) are formed on the top surface respectively close to the sides of the platform (10) and each transmission bracket (13) has a mounting hole (131)defined through the transmission bracket (13). The shoulder brackets (14) are formed on the top surface of the platform (10), correspond to the transmission brackets (13) and each has a top edge and an optional guide post (141) formed on the top edge. The post-rotating brackets (14*a*) are formed on the top surface ahead the shoulder bracket (14), are aligned respectively with the shoulder brackets (14) and each post-rotating brackets (14*a*) has a mounting hole (141*a*) defined into the post-rotating bracket (14*a*). The transverse rails (15) are formed on the top surface of the platform (10) respectively between the worm gear casing (12) and one of the post-rotating brackets (14*a*). The optional threaded shaft brackets (16, 16*a*) are mounted on the motor bracket (11) and are spaced apart with a longitudinal distance.

The motor assembly (20) is mounted on the platform (10) and has a motor (21) and a longitudinal worm (22). The motor (21) is mounted on the top surface of the platform (10) between the shoulder brackets (14) and has a front end. The longitudinal worm (22) is mounted rotatably on the front end of the motor (21) and extends into the worm gear casing (12).

The transmission assembly (30) is mounted rotatably between the transmission brackets (13) and has a transverse axle (31), a central worm gear (32), two driving worm gears (34), two optional gear casing assemblies (35) and two oblique wheels (36).

The transverse axle (31) is mounted rotatably through the mounting holes (131) in the transmission brackets (13), extends transversely through the worm gear casing (12) and is located above the longitudinal worm (22). The central worm gear (32) is mounted securely on the transverse axle (31), inside the room in the worm gear casing (12) and is engaged with the longitudinal worm (22). The driving worm gears (34) are mounted securely on the transverse axle (31) and are located respectively on the opposite sides of the worm gear casing (12).

The gear casing assemblies (35) are mounted securely on the transverse axle (31), correspond to and respectively cover the driving worm gears (34), are located respectively above the post-rotating brackets (14*a*) and each has a bottom casing (351) and a top casing (352). The bottom casing (351) is mounted securely on the transverse axle (31) around the corresponding worm gear (34) and has an open top and a through hole (3511). The through hole (3511) is defined through the bottom casing (351) and is aligned with the mounting hole (141*a*) of the corresponding post-rotating bracket (14*a*). The top casing (352) is mounted on the open top of the bottom casing (351) above the corresponding driving worm gear (34) and thereby the corresponding driving worm gear (34) is located inside the gear casing assembly (35).

The oblique wheels (36) are mounted securely on the transverse axle (31) between the driving worm gears (34) and are located respectively near the opposite sides of the worm gear casing (12). Each oblique wheel (36) has an oblique annular groove (361) defined around the oblique wheel (36) and a-perpendicular to the transverse axle (31).

The massage arm assembly (40) is mounted on the shoulder brackets (14) and post-rotating bracket (14*a*) on the platform (10) and has a shoulder (41), an optional threaded shaft (42), two rocker arms (43), two posts (44), two eccentric wheels (45) and two driven worm gears (46).

The shoulder (41) is mounted slidably or securely on the shoulder brackets (14) and has two sides, two mounting boards (411), two optional guide slots (412) and an optional shaft sleeve (413). The mounting boards (411) are formed respectively on the sides of the shoulder (41), correspond to and are mounted slidably and respectively on the shoulder brackets (14). Each mounting board (411) has a top surface. The guide slots (412) are defined longitudinally and respectively through the mounting boards (411), correspond to the guide posts (141) on the shoulder brackets (14) and respectively allow the guide posts (141) to slide thereinside. The shaft sleeve (413) is formed on the shoulder (41) between the threaded shaft brackets (16, 16*a*) and has a through hole and an inner thread. The through hole is defined through the shaft sleeve (413).

The threaded shaft (42) is mounted rotatably on the threaded shaft brackets (16, 16*a*) and extends through the through hole of the shaft sleeve (413) and has an outer thread engaging with the inner thread of the shaft sleeve (413), and thereby the rotation of the threaded shaft (42) results in the longitudinal movement of the shoulder (41). The rotation of the threaded shaft (42) moves the shoulder (41) forward or backward on the shoulder brackets (14).

Figure 4:
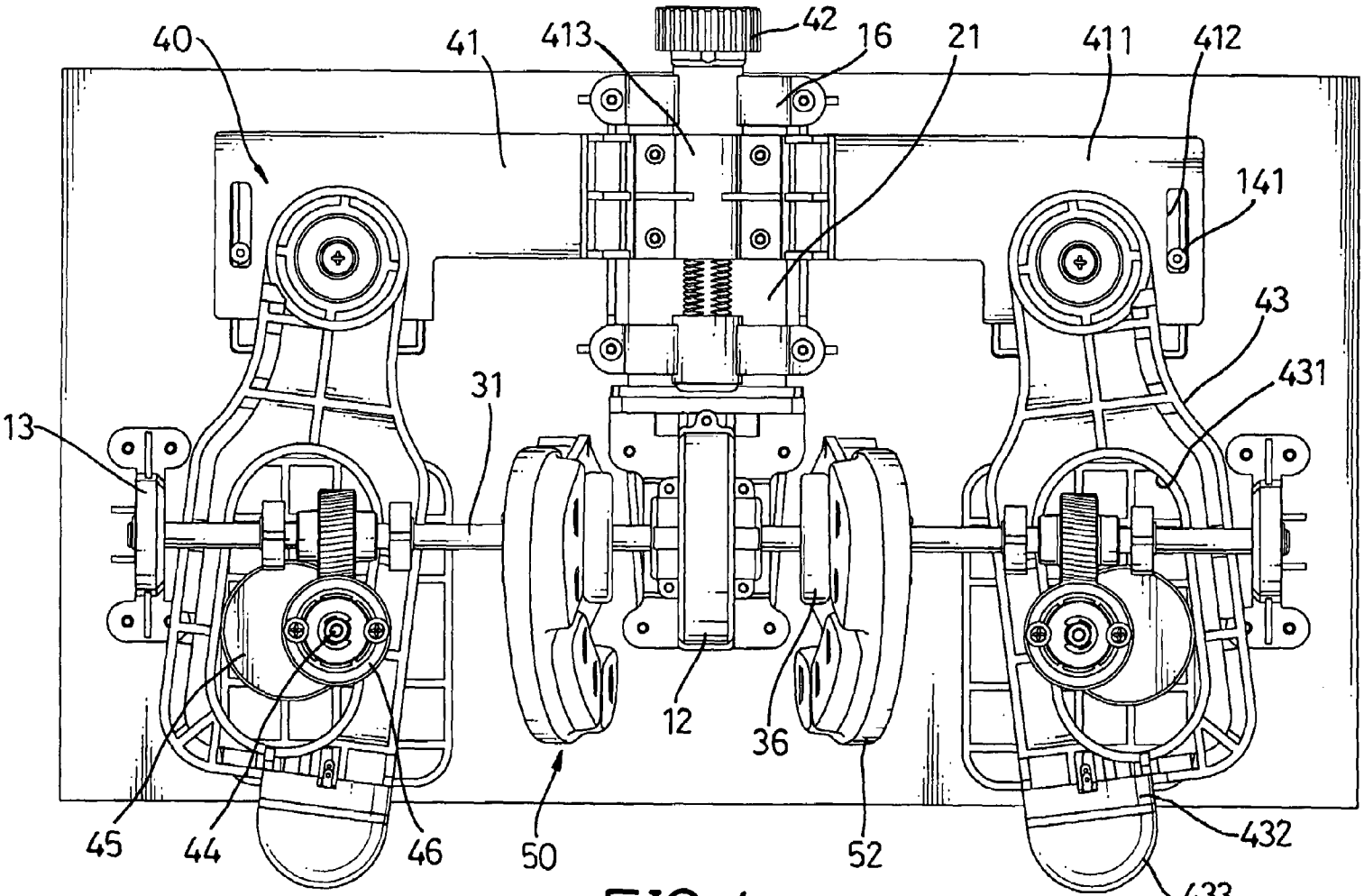
FIG. 4 is a top view of the massage device in FIG. 1.

With reference to FIG. 4, the rocker arms (43) are mounted rotatably and respectively on the top surfaces of the mounting boards (411) below the transverse axle (31), correspond to and are located respectively above the post-rotating brackets (14*a*). Each rocker arm (43) has a front edge, a slot (431), a head bracket (432) and a kneading head (433). The slot (431) is defined through the rocker arm (43) and has an inner width. The head bracket (432) is formed on the front edge of the rocker arm (43). The kneading head (433) is mounted on the head bracket (432).

The posts (44) correspond to the rocker arms (43) and the gear casing assemblies (35), are mounted rotatably and respectively into the mounting holes (141*a*) of the post-rotating brackets (14*a*), and extend respectively through the through holes (3511) of the gear casing assemblies (35) and the slots of the rocker arms (43).

The eccentric wheels (45), are mounted eccentrically and respectively on the posts (44), correspond to and are located respectively inside the slots (431) of the rocker arms (43). Each eccentric wheel (45) has a diameter slightly smaller than the inner width of the slot (431).

The driven worm gears (46) are mounted respectively on the posts (44) and above the eccentric wheels (45), are located respectively inside the gear casing assemblies (35) and correspond to and respectively engage with the driving worm gears (34).

Figure 3:
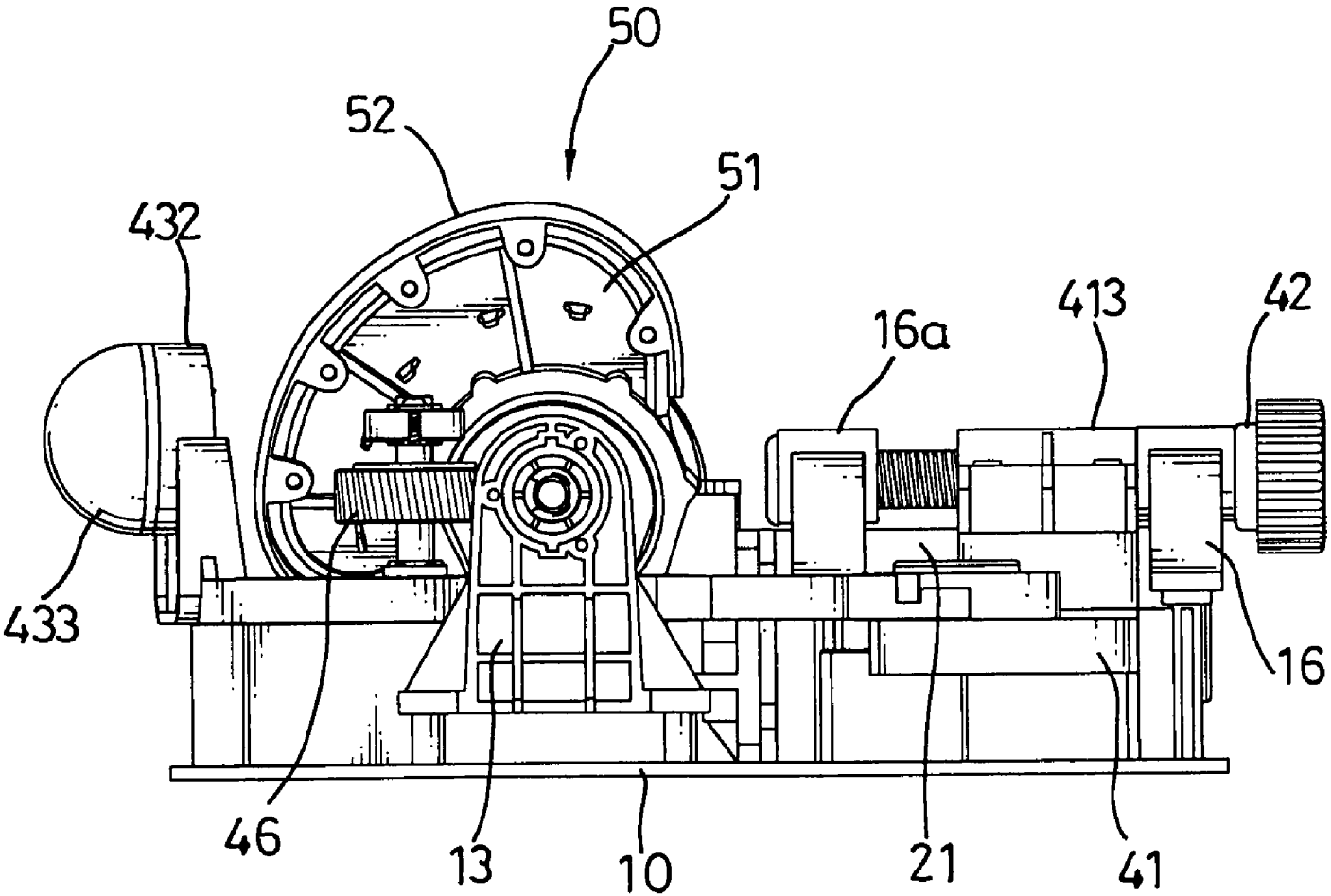
FIG. 3 is a left side view of the massage device in FIG. 1.
Figure 5:
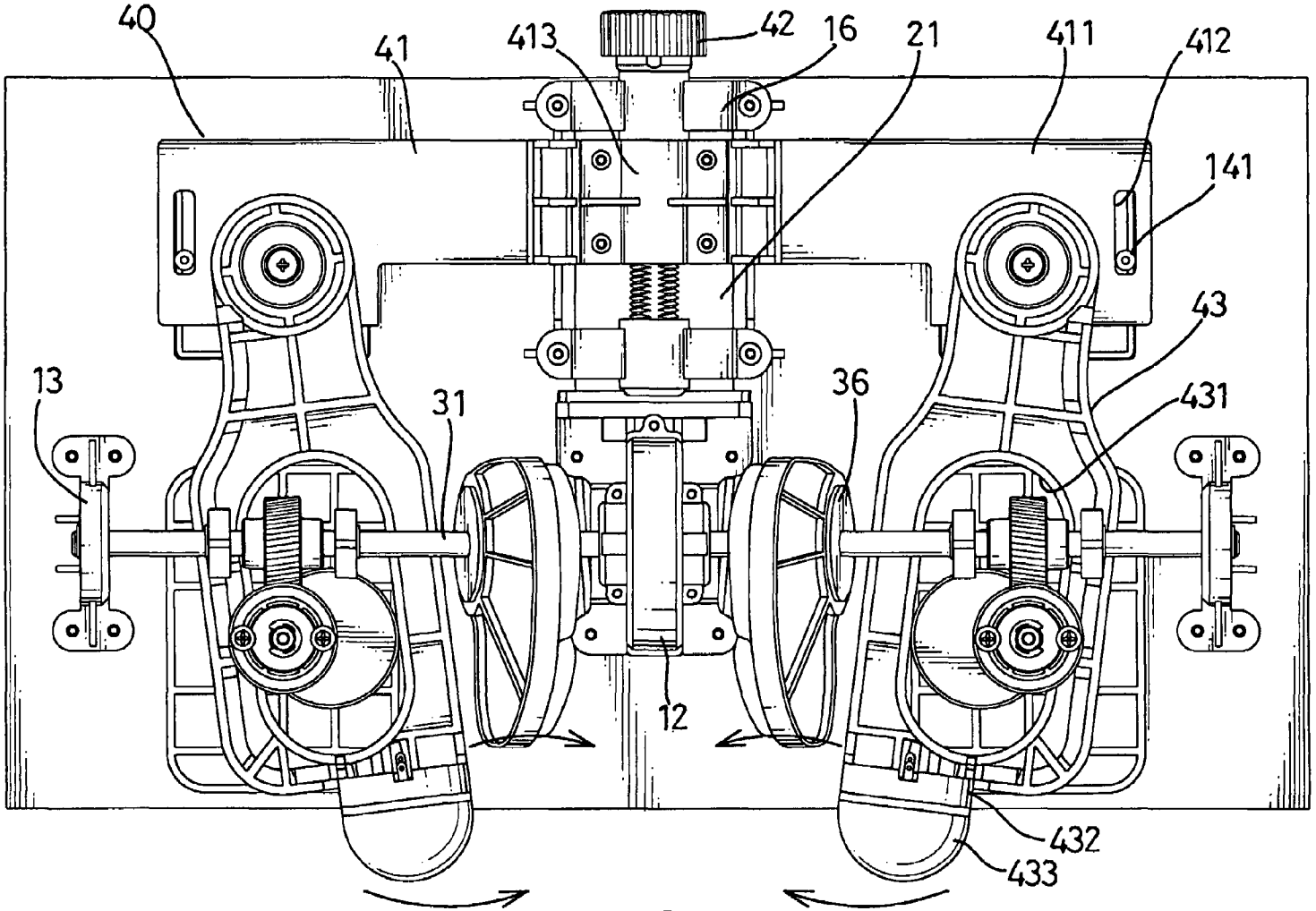
FIG. 5 is an operational view of the massage device in FIG. 4.

With reference to FIGS. 1, 3 and 5, the massage disk assemblies (50) correspond to and are mounted rotatably respectively in the oblique annular grooves (361) around the oblique wheels (36). Each massage disk assembly (50) has a massage disk (51) and a massage pad (52). The massage disk (51) is mounted rotatably in the annular groove (361) on a corresponding one of the oblique wheels (36) and has a bottom edge and a guide slider (511). The guide slider (511) is formed on the bottom edge of the massage disk (51) and slidably engages with a corresponding one of the transverse rails (15). The massage pad (52) is made of soft and resilient material such as rubber, is mounted on the massage disk (51) and faces the worm gear casing (12).

When operating with electricity, the motor (21) with the rotating longitudinal worm (22) drives the transmission assembly (30) to simultaneously actuate the massage arm assembly (40) and the massage disk assembly (50). The transverse axle (31) with the central worm gear (32) is rotated by the rotating longitudinal worm (22) and thereby simultaneously rotates the driving worm gears (34) and the oblique wheels (36).

With reference to FIGS. 4 and 5, each of the rotating driving worm gears (34) rotates the corresponding driven worm gear (46) with the post (44) and thereby rotates the eccentric wheel (45) on the post (44). The eccentric wheels (45) rotate respectively and eccentrically inside the corresponding slots (431) of the rocker arms (43) and make the rocker arms (43) rock left and right opposite to each other. When applying the massage arm assemblies (40) to a human body, the kneading heads (433) of the rocker arms (43) effectively knead back and forth parts of the human body, such as the muscles of the human shoulders.

Figure 6:
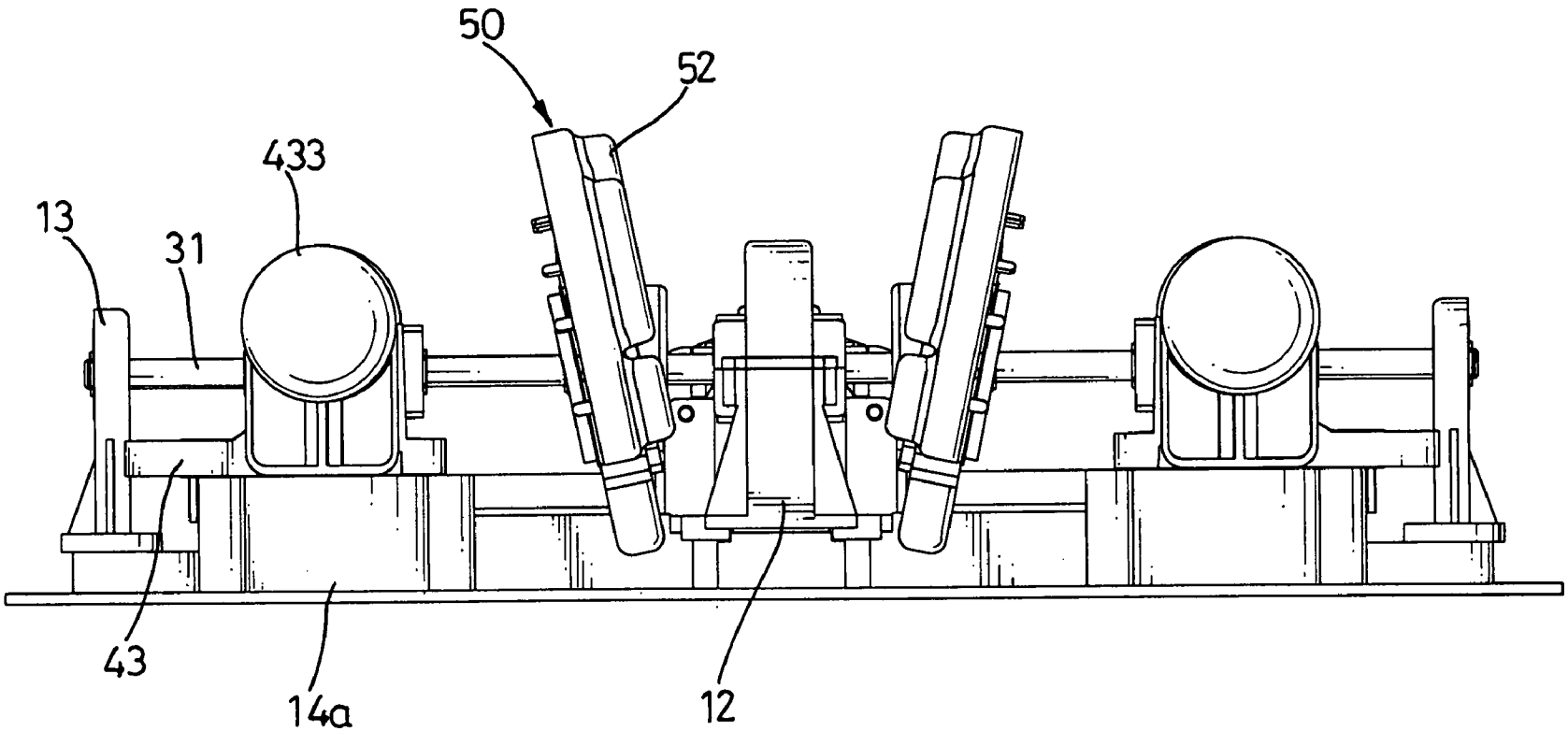
FIG. 6 is a front view of the massage device in FIG. 1.
Figure 7:
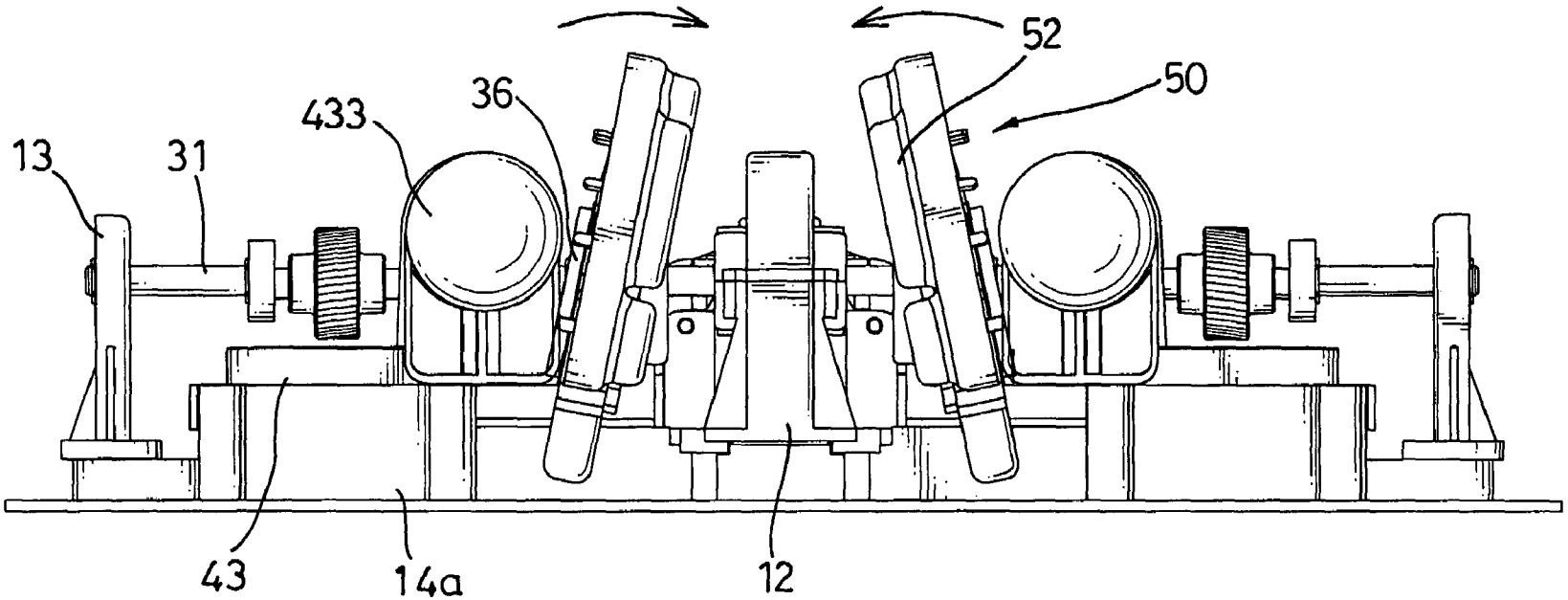
FIG. 7 is an operational view of the massage device in FIG. 6.

With reference to FIGS. 6 and 7, each of the oblique wheels (36) rotates relative to the corresponding massage disk assembly (50). The massage disk assemblies (50) respectively follow the rotating oblique annular grooves (361) in the oblique wheels (36) and to oscillate sinusoidally and complementally. When applying the massage disk assemblies (50) to the human body, the massages pad (51) effectively knead parts of the human body, such as the muscles of the neck.

The massage arm and disk assemblies (40, 50) simultaneously provide multiple effective massages to different groups of muscles of a human body to mitigate the ache of the muscles. The massage device in accordance with the present invention may be assembled into a bed or back of a chair and allow a user to lie or seat on the bed or chair for relaxation and enjoyment of the massages.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A massage device comprising:

a platform having a top surface;

two sides;

a motor bracket formed on the top surface of the platform;

a worm gear casing mounted on the top surface of the platform ahead the motor bracket and having two opposite sides and a room;

two transmission brackets formed on the top surface respectively close to the sides of the platform and each having a mounting hole defined through the transmission bracket;

two shoulder brackets formed on the top surface of the platform, corresponding respectively to the transmission brackets and each having a top edge;

two post-rotating brackets formed on the top surface of the platform ahead the shoulder brackets, aligned respectively with the shoulder brackets and each having a mounting hole defined into the post-rotating bracket; and two transverse rails formed on the top surface of the platform respectively between the worm gear casing and one of the post-rotating brackets;

a motor assembly mounted on the platform and having a motor mounted on the top surface of the platform between the shoulder brackets and having a front end; and a longitudinal worm mounted rotatably on the front end of the motor and extending into the worm gear casing;

a transmission assembly mounted rotatably between the transmission brackets and having a transverse axle mounted rotatably through the mounting holes in the transmission brackets, extending transversely through the worm gear casing and located above the longitudinal worm;

a central worm gear mounted securely on the transverse axle, inside the room in the worm gear casing and engaged with the longitudinal worm;

two driving worm gears mounted securely on the transverse axle and located respectively on the opposite sides of the worm gear casing; and two oblique wheels mounted securely on the transverse axle between the driving worm gears, located respectively near the opposite sides of the worm gear casing and each oblique wheel having an oblique annular groove defined on the oblique wheel and a-perpendicular to the transverse axle;

a massage arm assembly mounted on the shoulder brackets and post-rotating bracket on the platform and having a shoulder mounted on the shoulder brackets and having two sides; and two mounting boards formed respectively on the sides of the shoulder, corresponding to and mounted respectively on the shoulder brackets and each mounting board having a top surface;

two rocker arms mounted rotatably and respectively on the top surfaces of the mounting boards below the transverse axle, corresponding to and located respectively above the post-rotating brackets and each rocker arm having a front edge;

a slot defined through the rocker arm and having an inner width;

a head bracket formed on the front edge of the rocker arm; and a kneading head mounted on the head bracket;

two posts corresponding to the rocker arms and mounted rotatably respectively into the mounting holes of the post-rotating brackets and each post having a top end;

two eccentric wheels mounted eccentrically and respectively on the posts, corresponding to and located respectively inside the slots of the rocker arms and each eccentric wheel having a diameter slightly smaller than the inner width of the slot; and two driven worm gears mounted respectively on the posts and above the eccentric wheels and corresponding to and respectively engaging with the driving worm gears; and two massage disk assemblies corresponding to and mounted rotatably respectively in the oblique annular grooves around the oblique wheels and each massage disk assembly having a massage disk mounted rotatably in the annular grooves on corresponding one of the oblique wheels and having a bottom edge; and a guide slider formed on the bottom edge of the massage disk and slidably engaging with a corresponding one of the transverse rails; and a massage pad mounted on the massage disk and facing the worm gear casing.

2. The massage device as claimed in claim 1, wherein the platform further has two threaded shaft brackets mounted on the motor bracket and spaced apart with a longitudinal distance;

each shoulder bracket of the platform further has a guide post formed on the top edge;

the mounting boards of the shoulder mounted slidably and respectively on the shoulder brackets;

the shoulder of the massage arm assembly further has two guide slots defined longitudinally respectively through the mounting boards, corresponding to the guide posts on the shoulder brackets and respectively allowing the guide posts to slide inside the guide slots; and a shaft sleeve formed on the shoulder between the threaded shaft brackets and having a through hole and an inner thread; and the massage arm assembly further has a threaded shaft mounted rotatably on the threaded shaft brackets and extending through the through hole of the shaft sleeve and having an outer thread engaging with the inner thread of the shaft sleeve.

3. The massage device as claimed in claim 2, wherein the transmission assembly further has two gearing casing assemblies mounted securely on the transverse axle, correspond to the driving worm gears, the driven worm gears, the posts and the post-rotating brackets, located respectively above the post-rotating brackets and each gearing casing assembly covering a corresponding one of the driving worm gears and a corresponding one of the driven worm gears and having a bottom casing mounted securely on the transverse axle around the corresponding worm gear and having an open top; and a through hole defined through the bottom casing, aligned with the mounting hole of a corresponding one of the post-rotating brackets and located around the corresponding one of the posts; and a top casing mounted on the open top of the bottom casing above the corresponding one of the driving worm gears.

4. The massage device as claimed in claim 3, wherein the massage pad is made of soft and resilient material.

* * * * *